US005564191A

United States Patent [19]

Ozawa

[11] Patent Number: 5,564,191

[45] Date of Patent: Oct. 15, 1996

[54] ELECTRIC SHAVER

[75] Inventor: Tetsuya Ozawa, Matsumoto, Japan

[73] Assignee: Izumi Products Company, Nagano, Japan

[21] Appl. No.: 466,402

[22] Filed: Jun. 6, 1995

[30] Foreign Application Priority Data

Jan. 11, 1995 [JP] Japan ..... 7-002449

[51] Int. Cl.[6] ..... B26B 19/04

[52] U.S. Cl. ..... 30/43.92; 30/43.91

[58] Field of Search ..... 30/43, 43.7, 43.8, 30/43.9, 43.91, 43.92

[56] References Cited

U.S. PATENT DOCUMENTS

| | | | |
|---|---|---|---|
| 3,858,314 | 1/1975 | Brenneman et al. | 30/43.92 |
| 4,922,608 | 5/1990 | Pahl | 30/43.91 |
| 5,257,456 | 11/1993 | Franke et al. | 30/43.92 |
| 5,367,771 | 11/1994 | Mukai | 30/43.92 |
| 5,398,412 | 3/1995 | Tanahashi et al. | 30/43.92 |

FOREIGN PATENT DOCUMENTS

| | | | |
|---|---|---|---|
| 960450 | 1/1975 | Canada | 30/43.92 |
| 0151971 | 8/1985 | European Pat. Off. | 30/43.92 |

*Primary Examiner*—Hwei-Siu Payer
*Attorney, Agent, or Firm*—Koda and Androlia

[57] ABSTRACT

An electric shaver having a shaving head which can pivot and be depressed into the housing of the shaver. The shaving head is mounted on pivot shafts that can be moved toward the inside of the shaver housing, thus allowing the shaving head to be pressed into the housing but bounce back to the original position by vertical springs; and the shaving head also pivots about the pivot shafts but is forced back to its original and upright position by lateral springs.

6 Claims, 4 Drawing Sheets

ELECTRIC SHAVER

BACKGROUND OF THE INVENTION

1. Field of the Invention

The present invention relates to an electric shaver.

2. Prior Art

One example of a conventional electric shaver of a vibration type has a shaving head that pivots between a pair of supporting elements installed in the shaver's main-body housing. The shaving head has inner and outer blades, and the inner blade vibrates to slide along the undersurface of the outer blade to cut the hair.

Such an electric shaver is disclosed in, for example, Japanese Patent Application Laid-Open (Kokai) No. 62-227395. In this electric shaver, the axial line of the pivotal shaving head lies on the axis of the outer blade; and the outer blade is not movable in a vertical direction so that the apex of the outer blade is kept in contact with the skin when the shaver is used.

In this shaver, since the outer blade is positioned on the axial line of the pivotal shaft of the shaving head, and the shaving surface of the outer blade is not designed to move up and down relative to the axial line of the pivotal shaft, the shaving head is not movable into and away from the housing of the shaver. As a result, the shaving head merely makes a pivotal motion and the outer blade passes over the skin by such a pivotal or swinging motion of the shaving head; thus, shaving that conforms to one's facial configuration is not well executed. More specifically, when it is intended to move the outer blade along an uneven facial configuration, it is necessary to move the main body of the shaver to and away from the shaving target point on the face. In addition, since the shaving head can make pivot motions, if the shaver is moved with the outer blade being pressed strongly against the skin, the shaving head pivots in the opposite direction from the direction the shaver is moved on the face. Consequently, the deep cutting of whiskers that is done by stretching the skin while moving the shaver finely back and forth at the target point on the face is not available.

SUMMARY OF THE INVENTION

Accordingly, a primary object of the present invention is to provide an electric shaver which has a shaving head that is pivotal with respect to the skin and at the same time depressable into the shaver housing, so that whiskers can be cut with the skin stretched.

It is another object of the present invention to provide an electric shaver which can absorb the shock that might occur when the outer blade of the shaving head is pressed strongly against the skin.

The objects oaf the present invention are accomplished by a unique structure for an electric shaver that includes: a shaving head having an outer blade and an inner blade which reciprocates along the undersurface of the outer blade, a housing having a motor therein and the shaving head thereon in a pivotal fashion about pivot shafts provided between a pair of supporting elements that are installed facing each other at the open end of the housing, and a connecting assembly which connects the output shaft of the motor to the inner blade so as to reciprocate the inner blade, and the unique structure of the present invention is that the pivot shafts are installed on the supporting element via pressing elements so that the pivot shafts are movable towards the inside of the shaving housing by overcoming the pressing force of the pressing elements, and the connecting assembly is installed inside the housing so as to allow the shaving head to make both the pivotal motion and inwardly depression motion.

In the above structure, it is preferable to have guide grooves on the facing surfaces of the supporting elements so that a floating bearing which supports the pivot shafts are set inside the guide grooves in a movable fashion and that the pressing elements are installed in the grooves. Furthermore, the floating bearing may be formed in an inverted U-shape in cross section that opens toward the housing so that the pressing elements are set inside the floating bearing.

In addition, the connecting assembly comprises a vibration plate and an eccentric cam. The inner blades are mounted to the vibration plate, and the vibration plate is provided inside the shaving head so that the vibration plate can make a reciprocating motion in the axial direction of the pivot shafts; and in addition, the vibration plate has a long slot opened in the direction perpendicular to the reciprocating motion of the inner blades. The eccentric cam is fitted on the output shaft of the motor and has an eccentric shaft at a position offset from the output shaft; and the eccentric shaft is inserted loosely into the long slot of the vibration plate.

With the structure described above, the shaver is used by bringing the outer blade to contact the skin, and the electric shaver as a whole is moved over the skin, so that the outer blade is caused to rub across the skin to cut whiskers. In this case, the shaving head is inclined in the direction opposite from the cutting direction and is depressed slightly into the housing so that the head conforms to one's facial configuration. Since the distance between the outer blade and the axial line of the pivot shafts on which the shaving head is supported may differ at various positions, the strength with which the shaving head is pressed against the skin can vary depending upon the pivotal motion of the shaving head. Thus, deep shaving can be performed. In addition, when the outer blade is strongly pressed against the skin, the shaving head is depressed toward the inside of the housing, thus the shock of the contact can be absorbed.

Meanwhile, the shaving head can be urged to stay in the neutral or upright position by installing lateral spring elements between the shaving head and the housing; and with this structure, the outer blade can bite into the skin as a result of the reaction force of such a shaving head position.

DETAILED DESCRIPTION OF THE INVENTION

Figure 1:
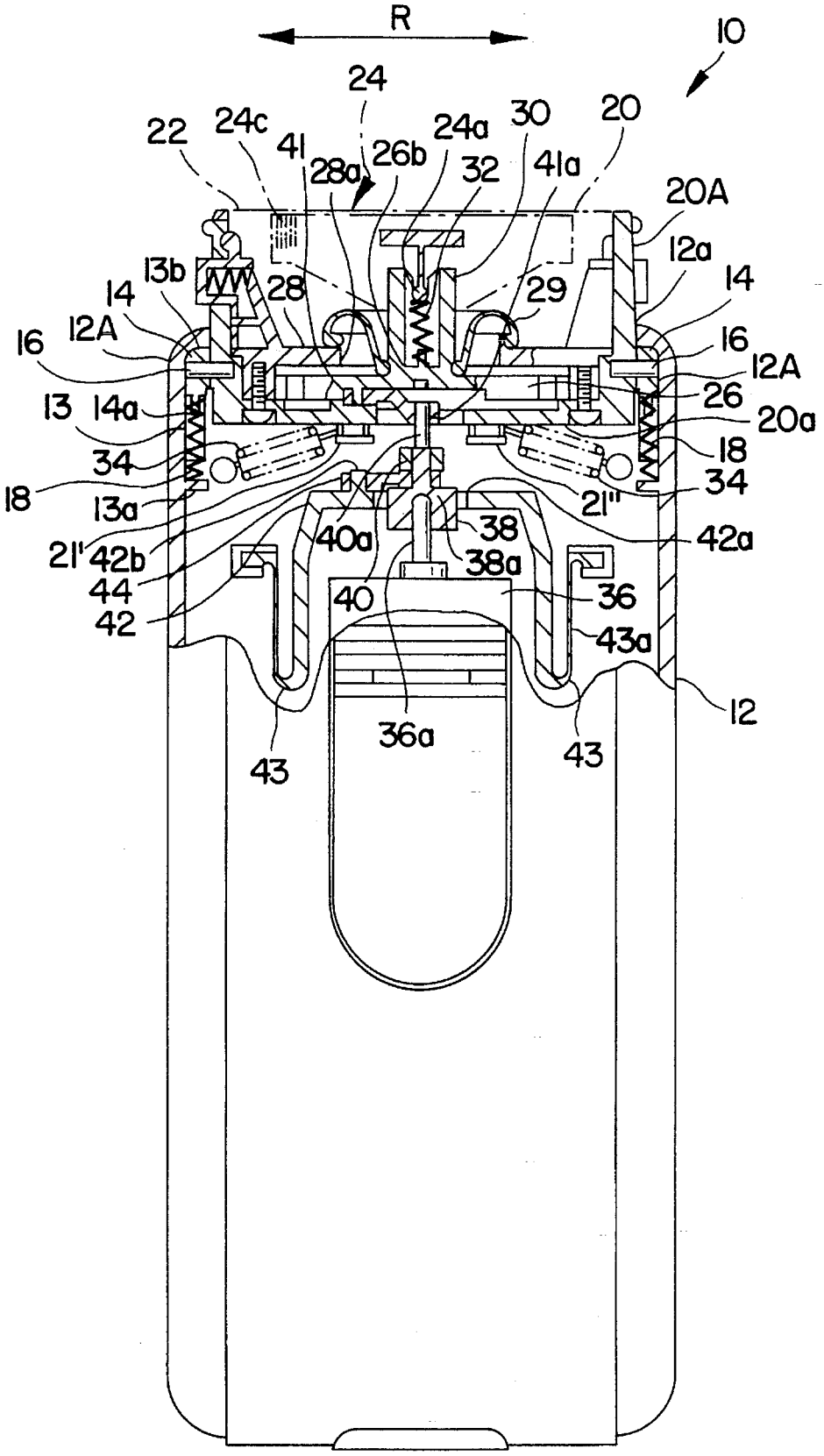
FIG. 1 is a partially sectional front view showing the internal mechanism of the electric shaver according to the present invention.
Figure 2:
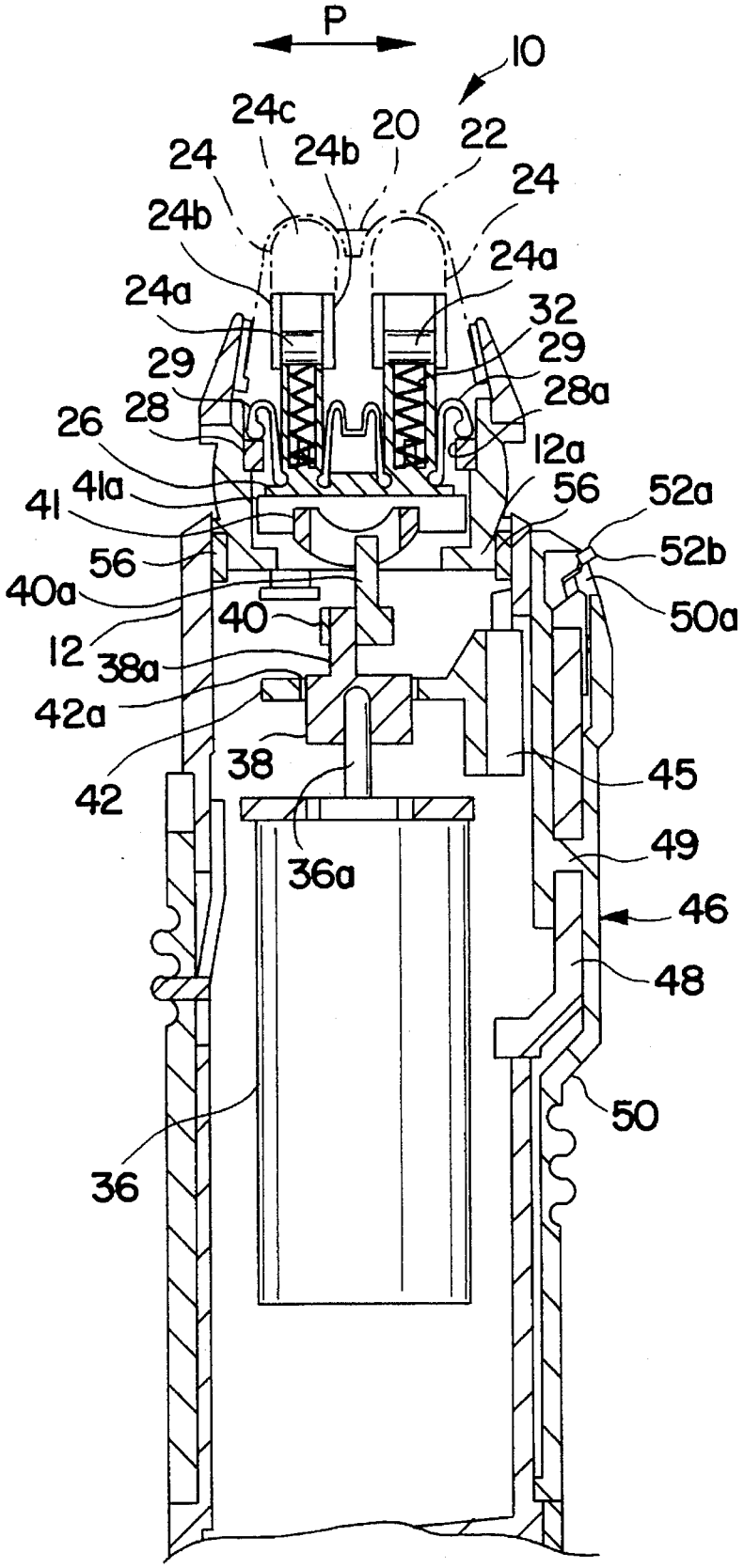
FIG. 2 is a side view thereof.

In FIGS. 1 and 2, the electric shaver according to the present invention is generally referred to with the reference numeral 10 and includes a housing 12 and a shaving head 20. The housing 12 has a pair of supporting elements 12A in a manner that the supporting elements 12A face each other and an opening 12*a* at one end or at an open end thereof (which is at the top end in the Figures). The upper ends of the supporting elements 12A are bent inward to form the opening 12*a*. The shaving head 20 is fitted inside the opening 12*a*.

A pair of floating bearings 14, each in an inverted U shape when seen from the side, are installed in recessed areas 13 which are formed as guide grooves in the respective inside surfaces of the supporting elements 12A. The shaving head 20 is mounted on these floating bearings 14 via pivot shafts 16 provided in the bearings 14 in a manner that the shaving head 20 can pivot about the pivot shafts 16.

The pivot shafts 16 are positionally coaxial and project toward each other and are located in positions whose distance from the bottom of the shaving head 20 is equal to about ¼ the height (in the vertical direction in FIG. 1) of the shaving head 20.

The floating bearings 14 have projections 14*a* projecting downward from the inside lower surfaces of the floating bearings 14, and the upper ends (in FIG. 1) of springs or pressing elements 18 are fitted over these projections 14*a*. The lower ends of these springs 18 are in contact with the bottom surfaces 13*a* of the recessed areas 13, so that the floating bearings 14 are constantly urged upwardly by the springs 18 and contact the ceiling surfaces 13*b* of the recessed areas 13. In other words, the pivot shafts 16 are kept pushed toward the opening 12*a* of the housing 10 by vertical pushing elements 18. This state is considered to be the initial position.

Figure 3:
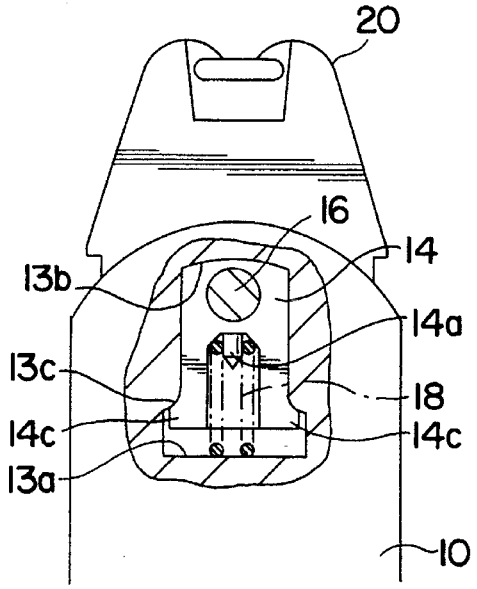
FIG. 3 is a side view of the shaver of the present invention with a part thereof shown as a cross section.

Furthermore, as shown in FIG. 3, the floating bearings 14 (only one,bearing is shown in FIG. 3) are provided with engaging parts 14*c* which extend outwardly from the lower areas of the floating bearings 14 in the direction of thickness (right and left directions in FIG. 3) of the housing 12. These engaging parts 14*c* respectively engage with step parts 13*c* formed in the lower portions of each recessed area 13; and when force (which is, for example, in a vertical direction in FIG. 3) is applied to the shaving head 20, the shaving head 20 is depressed toward the inside of the housing 12 together with the floating bearings 14.

As seen from FIG. 3, the pivot shaft 16 and the spring 18 are provided substantially at the center in the direction of the thickness of the shaver 10.

An outer blade 22 which, as best seen in FIG. 1, consists of two continuous peak-shaped projections is installed on the apex of the shaving head 20. A pair of inner blade units 24 are positioned so that they are in the respective projections of the outer blade 22. Thus, the embodiment shows a so-called dual track shaver as an example.

Each of the inner blade units 24 has a conventional well known structure. In other words, shafts 24*a* which connect a pair of side plates 24*b* positioned parallel to the direction of thickness (right and left directions in FIG. 2) of the housing 12 are installed in the lower center of each of the inner blade units 24, and a multiple number of plate blades 24*c* are installed at equal intervals on the side plates 24*b* (see FIG. 1) in such a manner that as shown in FIG. 2 the blades 24*c* straddle the space between the two side plates 24*b*.

The shaft 24*a* of each one of the inner blade units 24 is connected to a vibration plate 26 which is installed on the bottom 20*a* of the head case 20A of the shaving head 20 so that the vibration plate 26 is positioned in a space formed between the bottom 20*a* and partition bodies 28.

Figure 4:
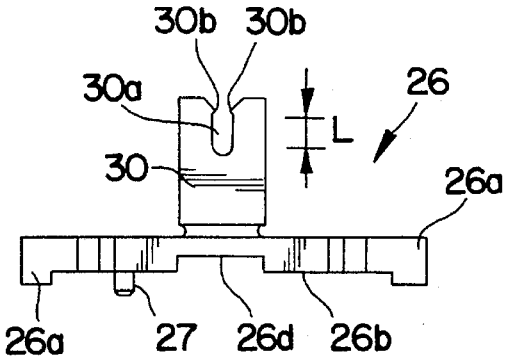
FIG. 4 is a front view of the vibration plate used in the shaver of the present invention.
Figure 5:
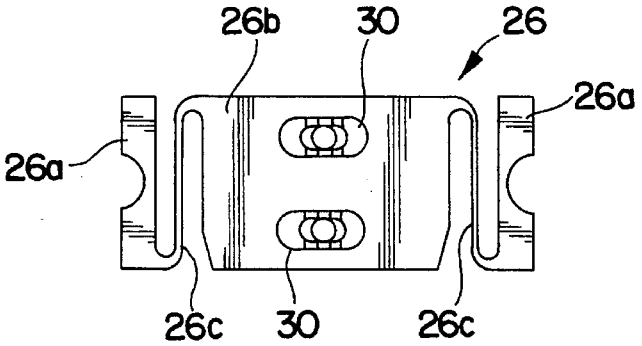
FIG. 5 is a top view thereof.

As shown in FIGS. 4 and 5, the vibration plate 26 has mounting areas 26*a* at both ends in the direction of the length of the vibration plate 26. These mounting areas 26*a* are connected to a central vibration area 26*b* via thin deformable connecting strips 26*c* which have a flat "S" shape so that the central vibration area 26*b* of the vibration plate 26 reciprocates in the left-right direction in FIGS. 4 and 5, in other words, in the axial direction of the pivot shafts 16 when actuated as described below. The mounting areas 26*a* are secured in the space formed between the bottom 20*a* and the partition body 28 so as to be located at both ends of the space in the direction of the supporting elements 12A.

The vibration plate 26 has two supporting tubes 30 provided upright on the upper surface of the vibration area 26*b* of the vibration plate 26. The supporting tubes 30 are located at the middle in the length wise direction of the vibration plate 26. As seen from FIG. 1, these supporting tubes 30 upwardly penetrate through the central opening 28*a* that is formed in the partition body 28.

Furthermore, as shown in FIG. 2, covers 29 made of rubber are installed so that the gaps between the supporting tubes 30 and the rim of the opening 28*a* of the partition body 28 are closed off. When the vibration plate 26 is reciprocated, the gaps between the supporting tubes 30 and the rim of the opening 28*a* are kept closed-off by the covers 29 that are deformed by the reciprocating motion of the vibration plate 26.

Each of the supporting tubes 30 is, as seen from FIG. 5, formed in the shape of a flattened oval having the longer diameter oriented in the direction of the reciprocating motion of the vibration plate 26 (right and left in FIGS. 4 and 5). Furthermore, as seen in FIG. 4, a slit 30*a* is formed in the direction of the shorter diameter of the flattened oval-shaped tube 30, and locking projections 30*b* which project toward each other are formed on the inner surfaces of and at the upper end of the slit 30*a*. As seen in FIG. 1, the lower end of the shaft 24*a* of the inner blade unit 24 is inserted into the slits 30*a* of the supporting tube 30 by letting the shaft 24*a* ride over the locking projections 30*b*.

In addition, a spring 32 is installed between each shaft 24*a* and each inside bottom of the corresponding supporting tube 30 so that the top edges of the blades of the inner blade unit 24 are kept in contact with the under surface of the outer blade 22 by the spring force of the spring 32.

When the outer blade 22 is deformed during the use of the shaver and the force is applied onto the inner blade units 24, the inner blade units 24 can be depressed inwardly so that the force is absorbed. The depression movement distance of the inner blade units 24 is indicated by L in FIG. 4 which is substantially equal to the depth of the slit 30*a*.

Figure 6:
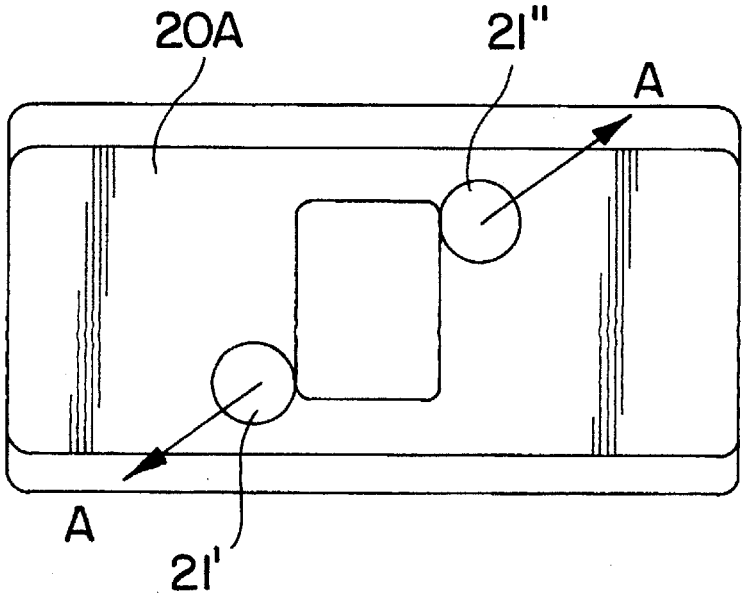
FIG. 6 is a bottom view of the head case of the shaver of the present invention.

The shaving head 20 is provided with projections 21' and 21" as shown in FIG. 6. The projections are on the bottom surface of the head case 20A that is a part of the shaving head 20. Springs 34 are, as shown in FIG. 1, connected between each of these projections 21' and 21" and the inner wall surface of the housing 12. The arrows A in FIG. 6 indicate the directions of the tension of the thus installed springs 34.

More specifically, these springs 34 are positioned substantially laterally as seen in FIG. 1. In addition, the springs 34 are provided so that one spring 34 is between the projection 21' and the inner surface of the front wall of the housing 12, and the other spring 34 is between the projection 21" and the inner surface of the back wall of the housing 12. With these lateral springs 34, the shaving head 20 can be kept in a neutral position (which is the upright position of the shaving head 20 as shown in FIG. 2 and not inclined to either the right or left in FIG. 2). When the shaving head 20 is depressed toward the inside of the housing 12, the springs 34 (which are coil springs) can expand and contract so as to follow such a head depressing motion.

A driving motor 36 that has an output shaft 36*a* is installed inside the housing 12 so as to be slightly above the middle point (in a vertical direction) of the housing 12 in FIG. 1, and the power of the motor 36 is transmitted to the inner blade units 24 via a connecting assembly. The connecting assembly has a structure as described below.

The connecting assembly comprises, as best seen in FIG. 2, a first eccentric cam 38 fitted on the output shaft 36*a* of the motor 36, a first eccentric shaft 38*a* formed on the first cam 38, a second eccentric cam 40 coupled to the first shaft 38*a*, and a second eccentric shaft 40*a* formed on the second cam 40.

More specifically, the first eccentric shaft 38*a* projects from the upper surface of the first eccentric cam 38 such that the axis of the shaft 38*a* is in an eccentric position which is offset from the axis of the output shaft 36*a* of the motor 36. The second eccentric cam 40 is fitted on the first eccentric shaft 38*a*, and the second eccentric shaft 40*a* projects from the upper surface of this second eccentric cam 40 such that the axis of the second eccentric shaft 40*a* is in an eccentric position which is offset from the axis of the output shaft 36*a* of the motor 36.

Furthermore, the eccentric shaft 40*a* is inserted loosely into an engagement hole 41*a* of a movable element 41, which has a shallow U-shape configuration as best seen in FIG. 1. The movable element 41 is fastened at its upper portion to the projection 27 (see FIG. 4) formed on the undersurface of the vibration plate 26, and the engagement hole 41*a* is formed in its lower portion of the movable element 41.

As is clear from FIGS. 1 and 2, the engagement hole 41*a* is a long slot oriented in the direction of the thickness of the housing 12 (right and left directions in FIG. 2), in other words, the hole 41*a* is long in the direction perpendicular to the axes of the pivot shafts 16. The eccentric shaft 40*a* of the connecting assembly is brought into this slot or hole 41*a* loosely in the direction of the thickness as referred to above, so that the vibration plate 26 can make only a horizontally reciprocating motion as shown by arrow R (or in the left-right direction) in FIG. 1 without hindering the shaving head 20 from making a pivotal motion as indicated by arrow P in FIG. 2.

With the above described connecting assembly, the rotation of the output shaft 36*a* of the motor 36 is transmitted to the movable element 41 via the eccentric cams 38 and 40 so as to vibrate the vibration plate 26 laterally, thus making the reciprocating motion of the inner blade units 24.

As described above, the shaving head 20 can not only be pivoted about the pivot shafts 16 by a force that overcomes the spring force of the lateral springs 34 but can also be depressed into the housing 12 by a force that overcomes the spring force of the vertical springs 18. However, the length of the eccentric shaft 40*a* is set so that the eccentric shaft 40*a* does not disengage from the engagement hole 41*a* of the movable body 41 even when the head 20 is depressed and pivoted. In addition, an escape hole 26*d* is formed in the undersurface of the vibration plate 26 so that the eccentric shaft 40*a* does not contact the vibration plate 26 even when the shaving head 20 is pivoted and depressed. In other words, the transmission of the driving force of the motor 36 to the inner blade units 24 is not hindered even when the shaving head 20 is pivoted about the shafts 16 and depressed into the housing 12.

In the above, the movable element 41 which has the engagement hole 41*a* is a separate element from the vibration plate 26. However, it would be possible to form the engagement hole 41*a* directly in the vibration plate 26.

The reference numerals 56 shown in FIG. 2 are elastic elements. These elastic elements 56 are installed on the edges of the opening 12*a* of the housing 12 that are located in the pivoting direction P of the shaving head 20 so that the elastic elements 56 insure that no gap is formed between the shaving head 20 and the shaver housing 12 when the shaving head 20 is pivoted and depressed.

Next, the structure of trimmer unit 46 and the driving force transmission mechanism therefor will be described. The trimmer unit 46 is provided on the back of the shaver housing 12 and actuated by the motor 36 via an oscillating element 42.

More specifically, the first eccentric cam 38 of the connecting assembly connecting the motor 36 to the inner blade units 24 is, as shown in FIGS. 1 and 2, set in a through-hole 42*a* that is formed in the center of the oscillating element 42, and a crank arm 44 is installed so as to connect the pin 42*b* formed on the upper surface of the oscillating element 42 and the eccentric shaft 38*a* of the first eccentric cam 38. As a result, when the first eccentric cam 38 is rotated by the motor 36, the oscillating element 42 is oscillated in the left-right direction R in FIG. 1 by the crank arm 44. The oscillating element 42 has U shaped connecting arms 43 on both sides, as best seen in FIG. 1, and is fastened to the housing 12 via these connecting arms 43. The outside walls 43*a* of the connecting arms 43 are formed thin so as to be deformed; thus, the oscillating element 42 can oscillate in the direction of the connecting arms 43.

As shown in FIG. 2, the oscillating element 42 has a guide groove 45 on the back. The guide groove 45 is open at its top and bottom. When the trimmer unit 46 is moved up in FIG. 2, the tip or top end of a drive element 48 engages with the guide groove 45, and the oscillation motion of the oscillating element 42 is transferred to the trimmer unit 46 via such engagement of the drive element 48 and the guide groove 45 of the oscillating element 42.

The trimmer unit 46 includes a cover 50 which moves along the back surface of the housing 12, an immovable blade 52*a* and a movable blade 52*b* provided in an opening 50*a* which opens laterally (in FIG. 1) in the upper portion of the cover 50, and the drive element 48. The upper end of the drive element 48 is engaged with the movable blade 52*b*.

The drive element 48 is at its intermediate point provided on a shaft 49 inside the cover 50 so that the drive element 48 can oscillate in the direction R on the shaft 49. When the drive element 48 is pushed by hand and engaged with the guide groove 45 of the oscillating element 42, the drive element 48 is oscillated so that the movable blade 52*b* engaged to the drive element 48 slides along the immovable blade 52*a*, thus trimming hairs by the two blades 52*a* and 52*b*.

The electric shaver of the present embodiment is constructed as described above, and shaving is accomplished by switching the power of the electric shaver 10 on and moving the shaver 10 around on the skin while pressing the outer blade 22 of the shaving head 20 against the skin.

When the shaver 10 is moved on the skin, the shaving head 20 can pivot about the pivot shafts 16 so that the orientation of the outer blade 22 switches so as to conform to the configuration of the face. Thus, shaving is accomplished with the shaving head 20 kept pressed against the skin; and since the shaving head 20 is supported by the floating bearings 14, when a force is applied to the shaving head 20 or the shaving head 20 is pressed against the skin strongly, the shaving head 20 is depressed into the shaver housing 12 by overcoming the spring force of the springs 18 so that the force can be absorbed. As a result, the load applied to the outer blade 22 can be absorbed too.

The shaving action will now be described in greater detail.

When the electric shaver 10 as a whole is moved over the skin, the outer blade 22 rubs across the skin and cuts whiskers. In this case, the shaving head 20 can incline in the direction opposite from the shaving direction and is depressed inwardly; thus, the shaving head 20 can conform to any facial configuration and shaving is accomplished with the shaving head 20 fitted properly against the skin.

In addition, the distance between the outer blade and the axial line of the pivot shafts 16 on which the shaving head 20 is supported can differ at various positions along the outer blade, and the strength with which the shaving head is pressed against the skin can vary depending upon the pivoting motion of the shaving head; thus, it is possible to perform deep shaving. In addition, because of the laterally oriented springs 34, the shaving head 20 tends to keep its neutral or upright position, and the reaction force of such tendency causes a pivot motion of the shaving head 20 in the direction opposite from the movement of the shaver. Thus, the outer blade 22 can bite in more strongly, making deep shaving possible.

In the embodiment described above, the shaving head 20 is supported on the floating bearings 14 via the pivot shafts 16 so that the shaving head 20 may pivot about these shafts 16, and the floating bearings 14 are supported by vertically oriented springs 18 so as to be depressed toward the inside of the housing.

Figure 7:
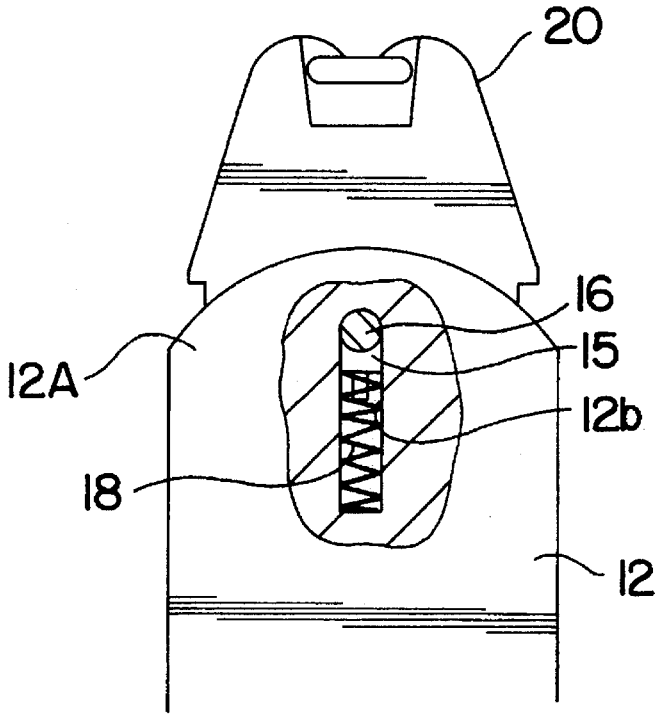
FIG. 7 is a side view of the shaver, illustrating the floating structure of the shaving head shown particularly in cross section.

However, it is also possible to construct the shaver as shown in FIG. 7. In this case, guide grooves **12*b* (only one shown) which guide the pivot shafts 16 (only one shown) in an up and down direction in FIG. 7 are formed in the inside surfaces of the supporting elements 12A, bearing elements 15 (only one shown) which support the pivot shafts 16 are installed inside these guide grooves 12*b*, and springs (only one shown) 18 are installed between these bearing elements 15 and the bottom surfaces of the guide grooves 12*b*. In this structure, the shaving head 20 pivots about the pivot shafts 16** and is free to move up and down.

The present invention is not limited to the embodiment described above. It goes without saying that numerous modifications may be made without departing from the spirit of the present invention.

As seen from the above, according to the present invention, the shaving head is supported between a pair of supporting shafts so that the shaving head can pivot about these supporting shafts. In addition, the pivot shafts can be depressed toward the inside of the housing. Accordingly, when a large force is applied to the shaving head, the shaving head is depressed into the housing, and the force is absorbed. Thus, the load applied to the outer blade can be absorbed.

In addition, when the shaver of the present invention is moved around on the skin so that the outer blade rubs across the skin and cuts whiskers, the shaving head is inclined in the direction opposite from the shaving direction and is depressed inwardly so that it conforms to the facial configuration. Accordingly, shaving can be accomplished with the shaving head fitted always on the skin. Moreover, since the distance between the outer blade and the axial line of the pivot shafts on which the shaving head is mounted may differ at various positions along the outer blade, the strength with which the shaving head is pressed against the skin can vary depending upon the pivoting movement of the shaving head, so that deep shaving is possible.

Furthermore, since shaving can be accomplished with the outer blade of the shaving head fitted against the skin, whiskers can be shaved by rubbing the skin with the head inclined; and since the pivoting shaving head is kept so as to be in a neutral or upright position by the spring force, the reaction force causes the outer blade to bite more strongly into the skin.

I claim:

1. An electric shaver comprising:

a shaving head having an outer blade and an inner blade which slides along an inside of said outer blade, a housing in which said shaving head is supported so that said shaving head is free to pivot about pivot shafts between a pair of supporting elements which are installed facing each other at one end of said housing, said housing being provided with therein a motor, and a connecting assembly which connects an output shaft of said motor to said inner blade so as to drive said inner blade, said shaver being characterized in that:

pivot shafts are supported in a movable manner on said supporting elements via pressing means so that said shaving head that overcomes a pressing force of said pressing means can be depressed toward an inside of said housing; and said connecting assembly is installed so as to connect said output shaft to said inner blade while allowing pivoting and inward depression motions of said shaving head.

2. An electric shaver according to claim 1 characterized in that guide grooves are formed in facing surfaces of said supporting elements, floating bearings which support said pivot shafts are provided inside said guide grooves so that said floating bearings are capable of movement, and said pressing means are installed inside said grooves.

3. An electric shaver according to claim 2 characterized in that said floating bearings are formed so that they have inverted U cross sections that open toward said housing, and said pressing means are installed so that they are positioned inside said floating bearings.

4. An electric shaver according to claim 1, 2 or 3 characterized in that said connecting assembly comprises:

a vibration plate to which said inner blade is connected, said vibration plate being supported inside said shaving head so that said vibration plate is able to make a reciprocating motion in an axial direction of said pivot shafts of said shaving head and having a long slot formed in a direction perpendicular to said reciprocating motion, and an eccentric cam fitted on said output shaft of said motor and having an eccentric shaft in a position offset from said output shaft so that said eccentric shaft is inserted loosely into said long slot of said vibration plate.

5. An electric shaver according to claim 4 characterized in that a multiple number of tension springs are provided with different orientations so as to position said shaving head in a neutral position, each of said tension springs having one end fastened to said housing and another end thereof being fastened to said shaving head.

6. An electric shaver according to claim 1, 2 or 3 characterized in that a multiple number of tension springs are provided with different orientations so as to position said shaving head in a neutral position, each of said tension springs having one end fastened to said housing and another thereof being fastened to said shaving head.

* * * * *